US006026825A

United States Patent [19]

de Laforcade

[11] Patent Number: 6,026,825

[45] Date of Patent: Feb. 22, 2000

[54] SYSTEM AND METHOD FOR APPLYING PRODUCT TO HAIR

[75] Inventor: Vincent de Laforcade, Rambouillet, France

[73] Assignee: L'Oréal S.A., Paris, France

[21] Appl. No.: 09/322,148

[22] Filed: May 28, 1999

[30] Foreign Application Priority Data

May 29, 1998 [FR] France ..... 98 06824

[51] Int. Cl.[7] ..... A45D 40/26

[52] U.S. Cl. ..... 132/218; 401/122

[58] Field of Search ..... 132/218, 216, 132/217; 401/9, 10, 122, 126, 129; 15/160, 206

[56] References Cited

U.S. PATENT DOCUMENTS

| | | | |
|---|---|---|---|
| 1,905,399 | 4/1933 | Wagner | 132/218 |
| 2,242,016 | 5/1941 | McKinney, Jr. . | |
| 2,537,468 | 1/1951 | Lanius, Jr. . | |
| 4,458,701 | 7/1984 | Holland | 132/218 |
| 5,007,442 | 4/1991 | Hirzel | 132/218 |

FOREIGN PATENT DOCUMENTS 93 16 704 2/1994 Germany .

OTHER PUBLICATIONS

English language Derwent Abstract of the PCT equivalent (WO 9512332) of DE 93 16 704, No Date.

*Primary Examiner*—Gene Mancene
*Assistant Examiner*—Philo Gene Pedro
*Attorney, Agent, or Firm*—Finnegan, Henderson, Farabow, Garrett & Dunner, L.L.P.

[57] ABSTRACT

A system for applying product to keratinous fibers includes an applicator and a container. The applicator includes an applicating member having an applicating surface configured to contact a lock of keratinous fibers and to apply product to the lock. The applicator also includes a positioning member that opposes at least a portion of the applicating surface and is configured to position the lock on the portion of the applicating surface when the applicating member is moved along the lock from the base of the lock to the tip of the lock. The container includes a reservoir and a receiving element. The reservoir has an interior configured to contain product and an opening permitting placement of the applicating member in the interior of the reservoir. The receiving element is configured to receive the positioning member and to locate the positioning member outside of the interior of the reservoir when the applicating member is in the interior of the reservoir. Methods for applying product to keratinous fibers using an application system are also provided.

30 Claims, 2 Drawing Sheets

SYSTEM AND METHOD FOR APPLYING PRODUCT TO HAIR

BACKGROUND OF THE INVENTION

1. Field of the Invention

The present invention relates to a system for applying product to keratinous fibers. As used in this application, the term "keratinous fibers" refers to growth of body hair, such as hair on the head and eyelashes. In particular, the present invention relates to a system for applying product, such as mascara, to the hair of the head and to eyelashes.

2. Description of the Related Art

Applicator brushes for applying mascara to eyelashes are known in the art. For example, U.S. Pat. No. 5,007,442 discloses a mascara applicator assembly including an applicator brush (i.e., a twisted brush type) and a comb capable of engaging a substantial portion of the applicator brush. The applicator brush and the comb are configured so that they may be stored together inside a reservoir containing a product by inserting them both through a common opening leading to an interior of the reservoir. Although attempts have been made to market an applicator with such a configuration, there are several problems associated with this design. For example, when the applicator is in the storage position inside the reservoir, the portion of the applicator brush that engages the comb is isolated from the product in the reservoir by the comb. In particular, the comb forms a barrier between the product and a substantial part of the applicator brush. Storing the applicator brush while engaged with the comb disadvantageously prevents the applicator member from becoming properly loaded with product. Further, having the applicator brush engaged with the comb in the reservoir obstructs the user's ability to wipe excess product from the applicator brush to assure an even coating on the applicator brush for treatment of the eyelashes.

In light of the foregoing, there is a need in the art for an improved system and an improved method for applying product to keratinous fibers.

Accordingly, the present invention is directed to systems and methods for applying product to keratinous fibers that obviate one or more of the short-comings of the related art.

A preferred object of the present invention is to provide a system for applying product to keratinous fibers, especially mascara to eyelashes, including an applicator having a positioning member that does not have one or more of the drawbacks of the prior art applicators.

Another preferred object of the present invention is to provide an application system that provides superior application quality and is easily transported during periods of non-use, particularly in a user's handbag.

A further preferred object of the present invention is to provide an application system that is simple and ergonomic to use, and is economical to produce.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a system for applying product to keratinous fibers including an applicator and a container. The applicator includes an applicating member having an applicating surface configured to contact a lock of keratinous fibers and to apply product to the lock. The applicator also includes a positioning member that opposes at least a portion of said applicating surface and is configured to position the lock on said portion of said applicating surface when the applicating member is moved along the lock from the base of the lock to the tip of the lock. The container includes a reservoir and a receiving element. The reservoir has an interior configured to contain product and an opening permitting placement of the applicating member in the interior of the reservoir. The receiving element is configured to receive the positioning member and to locate the positioning member outside of the interior of the reservoir when the applicating member is in the interior of the reservoir.

In another aspect, the applicator includes a handle connected to both the applicating member and the positioning member. The handle is preferably configured to engage a portion of the reservoir to sealingly close the opening of the reservoir when the applicating member is in the reservoir.

The receiving element preferably separates the positioning member from the applicating member and the product contained in the reservoir so that the positioning member does not interfere with the loading of product to the applicating member or the wiping of excess product from the applicating member. The receiving element preferably prevents the positioning member from soiling the surroundings when transporting the application system, particularly when transporting the system in a handbag. In addition, the receiving element preferably protects the positioning member from being damaged or broken when the application system is being transported. Preferably, the receiving element also facilitates closing and improved sealing of the reservoir. The application system preferably stands upright when positioned on a flat surface, such as a shelf or the top of a unit in the bathroom.

Aside from positioning a lock of keratinous fibers on the applicating member, the positioning member preferably provides other benefits. For example, when applying a product to eyelashes, the positioning member makes it possible to curl the eyelashes by moving the applicator in a curved path along the eyelashes from the base of the eyelashes to the tip of the eyelashes, with the eyelashes between the positioning member and the applicating member. The positioning member can also facilitate lengthening of the eyelashes by positioning the eyelashes between the positioning member and the applicating member, and then moving the applicator in a straight path from the base of the eyelashes to the tip of the eyelashes. In addition, the positioning member makes it possible to isolate, position, and treat a specific lock of keratinous fibers with the applicating member. Isolating a specific lock is particularly advantageous when the application system is used to apply a hair composition, particularly a mascara, to locks of hair.

In a further embodiment, the positioning member includes a plurality of at least one of teeth and bristles. Preferably, the positioning member includes at least one row of teeth or bristles that form a comb. The teeth and/or bristles facilitate separation of the keratinous fibers (e.g., eyelashes) prior to and/or after application of the product. In one embodiment, the teeth and/or bristles forming the comb are on a side of the positioning member that is intended to engage with the applicating member to facilitate separation of the keratinous fibers during application of product. In an alternate embodiment, the teeth and/or bristles forming the comb are on the opposite side of the positioning member to facilitate the preparation of a lock of hair prior to application of product to the lock and/or to finish the treatment of the lock after application of product. Thus, using the same application system, both application of product and combing of a lock of hair may be performed, obviating the prior need for an auxiliary comb required by some conventional systems.

One of ordinary skill in the art will recognize that the positioning member may include variations other than a comb. For example, the positioning member may include a brush, a block of foam, or a spatula, to name a few.

Preferably, the applicating surface of the applicating member extends around an axis to form a closed envelope. The portion of the applicating surface opposite to the positioning member preferably extends in an angular region about the axis up to approximately 180°. More preferably, the angular section is up to approximately 120°. This configuration allows a user to use a portion of the applicating member without interference from the positioning member and without having to retract the positioning member. For example, after application of the product, the portion of the applicating member not opposed to the positioning member may be used to apply finishing touches to the treated keratinous fibers, such as separating and/or smoothing the eye lashes when the system is used for applying mascara to the eyelashes. Thus, the same applicator can be used for applying a product to locks of keratinous fibers using both the applicating member and the positioning member, and for applying a product to locks of keratinous fibers without using the positioning member The positioning member is preferably fixed with respect to the applicating member, which facilitates insertion of the applicator into the container. Preferably, the positioning member and the applicating member are substantially parallel to one another.

The applicator preferably includes a wand having first and second ends and a handle. Preferably, the applicating member has a free end and an end opposite to the free end. The end of the applicating member opposite to the free end is preferably on the first end of the wand. The second end of the wand is preferably connected to the handle.

The applicating member may includes various configurations. For example, the applicating member may include a brush having axial bristles, a comb, a block of foam, or a brush with non-axial bristles. Preferably, the applicating member includes a brush having a core including bristles extending radially around the core.

In one embodiment, the applicator includes an arm having first and second ends. The positioning member is preferably on the first end of the arm. The second end of the arm is preferably connected to the handle. Preferably, the applicator is configured so that when the applicating member is placed in the interior of the reservoir, the arm extends in a direction substantially parallel to an axis of the reservoir, outside of the reservoir. The arm and the positioning member are preferably close to or even in contact with the exterior surface of the reservoir when the applicator is on the container, thereby reducing the overall size of the system.

Preferably, the receiving element includes a cup at least partially surrounding the reservoir. The cup preferably has a closed end adjacent to a bottom of the reservoir and an open end opposite to the closed end. The open end permits passage of the positioning member into the cup. The distance between the closed end and the open end is preferably at least as long as the axial length of the positioning member. Preferably, the closed end includes a flat surface and the cup has a cross-sectional width larger than the cross-sectional width of the reservoir. This configuration increases stability of the system so that the system will stand upright when it is placed on a flat surface, such as a shelf or the top of a unit in the bathroom. In one embodiment, the exterior surface of the cup is used for printing information, such as marketing information, advertising information, and/or instructions for using the system.

Preferably, the handle and the reservoir include threads. The threads on the handle are preferably configured to engage the threads on the reservoir. The receiving element is preferably coupled to the reservoir so that the receiving element does not rotate relative to the reservoir. Preferably, the positioning member is coupled to the handle so that the positioning member does not rotate relative to the handle. The presence of the receiving element also advantageously facilitates tightening of the handle on the reservoir, thereby improving the sealing of the reservoir. The receiving element preferably allows the handle to be screwed onto the reservoir without obstruction from the arm extending alongside of the reservoir.

Preferably, the positioning member is configured to move from a first position remote from the applicating surface of the applicating member to a second position adjacent to the applicating surface to facilitate positioning of a lock of keratinous fibers on the applicating surface. The positioning member is preferably biased toward the first position and moved from the first position to the second position by elastically deforming the arm. Preferably, the applicator includes a surface for receiving a pressing force for moving the positioning member from the first position to the second position. In one embodiment, the surface is a portion of the arm partway between the handle and the positioning member. The positioning member is preferably moved from the first position to the second position by exerting pressure on the surface at approximately a right angle to an axis of the applicating member using, for example, an index finger.

Preferably, the applicator includes a selecting portion for selecting a particular lock of keratinous fibers and a guide to facilitate positioning of the lock on the applicating surface. The selecting portion and the guide are preferably on the positioning member. The selecting portion preferably includes a point at a free end of the positioning member, allowing a user to select specific locks without the need to manipulate the locks with the user's fingers. The guide is preferably a stop adjacent to an end of the positioning member opposite to the free end. Preferably, the stop limits movement of the lock of keratinous fibers away from the selecting portion. These features are particularly advantageous when applying a coloring product to specific locks of keratinous fibers.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
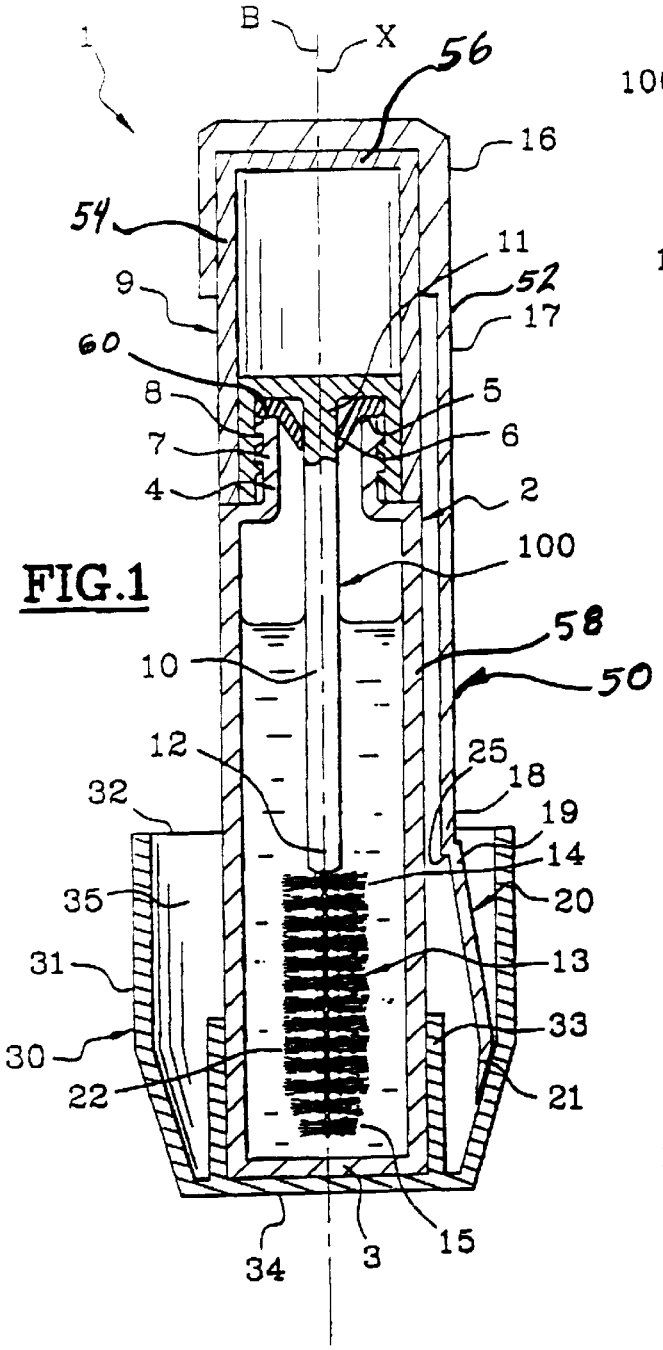
FIG. 1 shows a cross-sectional view of an embodiment of an application system including an applicator and a container.

Reference will now be made in detail to the present preferred embodiments of the invention, examples of which are illustrated in the accompanying drawings. Wherever possible, the same reference numbers are used in the drawings and the description to refer to the same or like parts.

As shown in FIG. 1, a system 1 comprises an applicator 100 and a container 50. The applicator 100 includes an applicating member 13 having a free end 15 and an opposite end 14. Preferably, the applicating member 13 includes a metal core holding a helical array of bristles extending radially around the core. The tips of the bristles define an applicating surface 22 that extends around an axis B to form a closed envelope. Preferably, the applicating surface 22 is substantially cylindrical along the majority of the length of the applicating surface 22 and is frustoconical shaped near the free end 15. The opposite end 14 of the applicating member 13 is on a first end 12 of a wand 10. A second end 11 of the wand 10 is preferably connected to a handle 9. Preferably, the handle 9 includes a cylindrical body 54 having a closed end 56 and an open end opposite to the closed end 56. The second end 11 of the wand 10 is preferably snap-fastened, bonded, or welded to an inner surface of the handle 9.

The applicator 100 also includes a positioning member 20 having a free end 21 and an opposite end 19. The opposite end 19 is on a first end 18 of an arm 17. Preferably, the positioning member 20 has an axial length that is approximately equal to the axial length of the applicating member 13 and is configured to engage only a portion of the applicating surface 22. For example, in one embodiment, the positioning member 20 is opposite to an angular region about the axis B of up to approximately 180° (i.e. approximately one-half of the longitudinal surface area of the applicating surface 22). More preferably, the angular region is up to approximately 120°. Most preferably, the angular region is between approximately 10° and approximately 60°. The profile of the positioning member 20 is preferably chosen to mirror the profile of the applicating surface 22. For example, as shown in FIG. 2A, the majority of the positioning member 20 is substantially parallel to the axis B and the free end 21 is slightly inclined toward the axis B to match the frustoconical profile of the free end 15 of applicating member 13.

The applicator 100 also preferably includes a selecting portion for selecting a specific lock of keratinous fibers and a guide to facilitate positioning of the lock on the applicating surface 22. Preferably, the free end 21 of the positioning member 20 is the selecting portion. The free end 21 is preferably tapered to a point to allow easy selection of a specific lock for treatment, for example, with a coloring product. Preferably, the portion between the first end 18 of the arm 17 and the opposite end 19 of the positioning member 20 forms a stop 25 that limits movement of the lock in a direction away from the free end 21 to facilitate positioning of the lock on the applicating surface 22.

Preferably, a second end 52 of the arm 17 is connected to a cylindrical sleeve 16 having an open end and a closed end. The open end of the cylindrical sleeve 16 is preferably positioned on an outer surface of the closed end 56 of the handle 9. The cylindrical sleeve 16 may be connected to the handle 9 by at least one of force-fitting, bonding, and welding. Preferably, the arm 17 extends from the cylindrical sleeve 16 in a direction substantially parallel to the axis B.

Figure 2A:
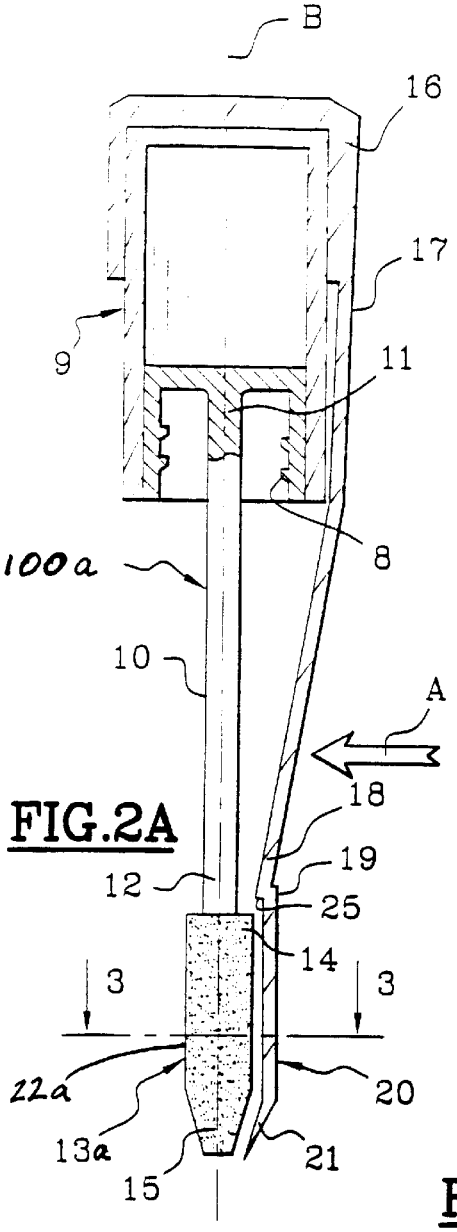
FIG. 2A shows a cross-sectional view of an alternate embodiment of an applicator.
Figure 2B:
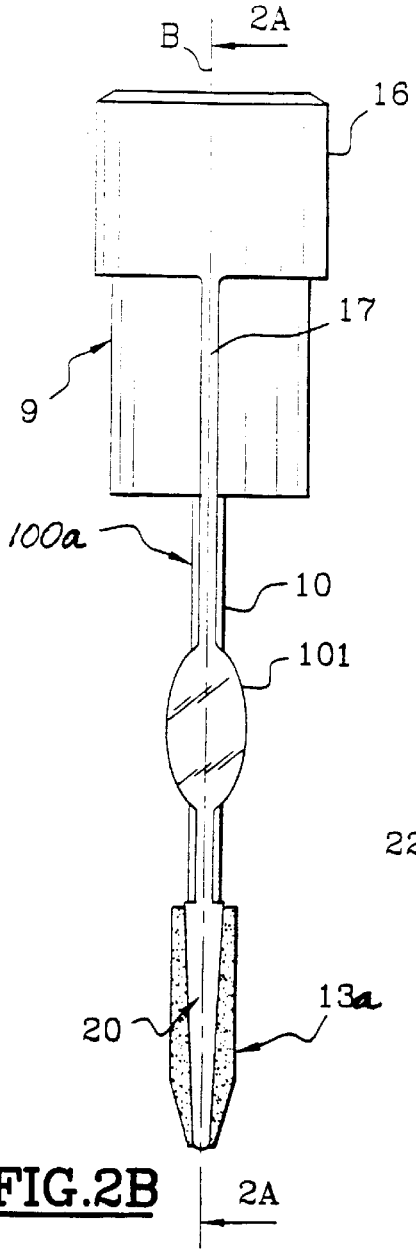
FIG. 2B shows a front view of the applicator of FIG. 2A.

FIGS. 2A–2B show an applicator 100*a* similar to the applicator 100 discussed with reference to FIG. 1. However, the applicator 100*a* includes an applicating member 13*a* including a block of open-cell or semi-open-cell foam with a similar profile to the profile of the applicating member 13 of FIG. 1.

Referring to FIGS. 2A–2B, the connection between the cylindrical sleeve 16 and the arm 17 preferably allows a user to move the positioning member 20 from a first position remote from the applicating member 13*a* to a second position adjacent to the applicating member 13*a* by applying a pressing force A to the arm 17 between the connection with the cylindrical sleeve 16 and the positioning member 20, in a direction substantially perpendicular to the axis B to elastically deform the arm 17. (Preferably, the positioning member 20 is biased toward the first position.) In the second position, the positioning member 20 is preferably substantially parallel to the axis B, except at the free end 21 where the positioning member 20 is inclined toward the axis B. In a preferred embodiment, the free end 21 of the positioning member 20 is approximately 10 mm to approximately 15 mm from the applicating member 13*a* when the positioning member 20 is in the first position. As shown in FIG. 2B, the arm 17 preferably includes a surface 101 for receiving the pressing force A (i.e., the pressing of a user's finger) that elastically deforms the arm 17 to move the positioning member 20 toward the second position.

Referring to FIG. 1, the container 50 includes a reservoir 2 having an interior configured to contain product and an opening permitting placement of the applicating member 13 in the interior of the reservoir 2. The container 50 also includes a receiving element 30 configured to receive the positioning member 20 when the applicating member 13 is in the interior of the reservoir 2. Preferably, the reservoir 2 has a cylindrical body 58 including a bottom surface 3 and a neck 4. A free edge 60 of the neck 4 defines an opening 5 leading to the interior of the cylindrical body 58. The cross-section of the neck 4 is preferably smaller than the cross-section of the cylindrical body 58 of the reservoir 2. Preferably, a wiper 6 is provided on the neck 4 for wiping excess product from the applicating member 13. The wiper 6 preferably includes an elastically deformable material forming a lip around the opening 5 and is preferably snap-fastened to the neck 4. Preferably, the wiper 6 is configured to meter the amount of product dispensed to the applicating member 13 and to wipe a surface of the wand 10 as the applicator 100 is removed from the container 50.

The exterior surface of the neck 4 of the reservoir 2 preferably includes threads 7 and the interior surface of the handle 9 preferably includes threads 8. Preferably, the threads 7 of the neck 4 engage the threads 8 of the handle 9 to sealingly close the opening 5 leading to the interior of the cylindrical body 58 of the reservoir 2. The length of the wand 10 is preferably designed so that the free end 15 of the applicating member 13 extends nearly to the bottom surface 3 of the cylindrical body 58 when the applicating member 13 is in the reservoir 2 and the handle 9 is screwed onto the neck 4. Preferably, the length of the arm 17 is designed so that the free end 21 of the positioning member 20 extends to approximately the same position as the free end 15 of the applicating member 13. When the handle 9 is screwed onto the neck 4, the free end 21 of the positioning member 20 is preferably slightly above the bottom surface 3 of the cylindrical body 58, and the arm 17 extends alongside of an external surface of the cylindrical body 58 in a direction substantially parallel to an axis X of the reservoir 2. The arm 17 is preferably a short distance away from, or even in contact with, the exterior surface of the cylindrical body 58.

Preferably, the receiving element 30 has a lateral skirt 31 having an open end defined by a free edge 32 of the receiving element 30 and the external surface of the cylindrical body 58. The receiving element 30 also has a bottom part 34 attached to a lower edge of the skirt 31 opposite to the free edge 32. A cylindrical wall 33 extends upwardly from the bottom part 34. The inside diameter of the cylindrical wall 33 is preferably configured to allow the receiving element 30 to be force-fit onto the lower portion of the cylindrical body 58. In the alternative, the receiving element 30 is bonded or welded to the lower portion of the cylindrical body 58. The lateral skirt 31 of the receiving element 30 is preferably frustoconical shaped near the bottom part 34 so that the receiving element 30 follows the profile of the free end 21 of the positioning member 20. An annular space 35 is defined by the receiving element 30 and the exterior surface of the cylindrical body 58. The annular space 35 extends over an axial height substantially equal to the axial height of the positioning member 20, so that the positioning member 20 can be received via an opening leading to the annular space 35, defined by the free edge 32 and the external surface of the cylindrical body 58, when the applicator member 13 is inside the reservoir 2. By way of example, the radial width of the annular space 35 is approximately 1 cm. However, one of ordinary skill in the art will recognize that the radial width of the annular space 35 is dependent on the profile and size of the positioning member 20.

Referring to FIGS. 1 and 2A–2B, to use the system 1 to apply a product to keratinous fibers, such as eyelashes and/or hair, the user grasps the receiving element 30 in one hand and the handle 9 (and/or the cylindrical sleeve 16) in the other hand. The user then twists one with respect to the other to unscrew the handle 9 from the reservoir 2. In so doing, the positioning member 20 turns freely in the annular space 35. Once the handle 9 has been completely unscrewed from the reservoir 2, the user removes the applicator 100, 100*a* from the container 50, wiping excess product from the applicating surface 22, 22*a* with the wiper 6. After removing the applicating member 13, 13*a* from the reservoir 2, the applicating surface 22, 22*a* of the applicating member 13, 13*a* should be perfectly loaded with product and ready for application.

To apply a hair coloring product, the user first selects a lock by picking the lock up from the base of the lock using the free end 21 of the positioning member 20. The user then slides the lock along the positioning member 20 to center the lock with respect to the applicating member 13, 13*a*. Next, the user applies a pressing force to the surface 101 of the arm 17 to elastically deform the arm 17 and to move the positioning member 20 from the first position to the second position. In the second position, the positioning member 20 pinches the lock against the applicating surface 22, 22*a* of the applicating member 13, 13*a*. Thereafter, the user moves the applicating member 13, 13*a* along the lock from the base of the lock to the tip of the lock to transfer the product from the applicating member 13, 13*a* to the lock.

Figure 4A:
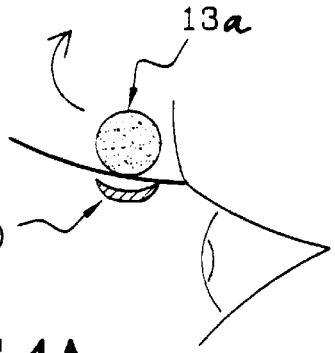
FIGS. 4A–4B show the use of the applicator of FIGS. 2A–2B to apply mascara to eyelashes.
Figure 4B:
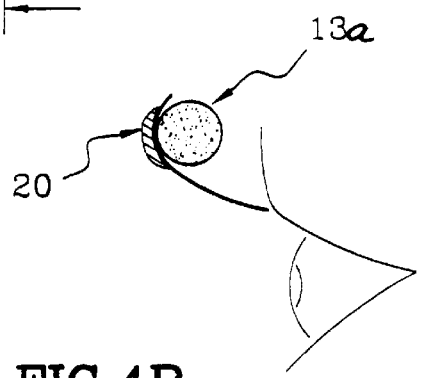

As shown in FIGS. 4A–4B, to apply mascara to eyelashes, the user positions the applicator 100, 100*a* so that the arch of the targeted eyelashes is positioned between the applicating member 13, 13*a* and the positioning member 20 near the base of the eyelashes. Next, the user applies a force to the surface 101 of the arm 17 to pinch the eyelashes between the applicating member 13, 13*a* and the positioning member 20. Thereafter, the user moves the applicator 100, 100*a* along the eyelashes in a path that sweeps up towards the tip of the eyelashes. Depending on the desired effect (e.g., curling or lengthening), the user may alter the path of the applicator 100, 100*a*. For example, the user can create different amounts of curl in the eyelashes depending on whether the path of the applicator 100, 100*a* is primarily curved or straight. Since the positioning member 20 holds the eyelashes against the applicating member 13, 13*a* from the base of the eyelashes to the tip of the eyelashes, the user can obtain very pronounced effects. Additionally, the user can orient the applicating member 13, 13*a* so that the portion of the applicating surface 22 not opposite to the positioning member 20 faces the eyelashes. With the applicator 100, 100*a* in this orientation, the user can finish the application by smoothing or separating the eyelashes without obstruction from the positioning member 20.

After applying the product, the user places the applicator 100, 100*a* on the container 50 by inserting the applicating member 13, 13*a* in the reservoir 2, via the opening 5, and locates the positioning member 20 in the receiving element 30. Next, the user turns the handle 9 with respect to the reservoir 2 while grasping the receiving element 30 in one hand and the handle 9 (and for the cylindrical sleeve 16) in the other hand. The user twists the handle 9 relative to the receiving element 30 until the handle 9 is completely screwed onto the reservoir 2. The larger cross-section of the receiving element 30 as compared to the cylindrical body 58 of the reservoir 2 provides for a greater tightening torque than that obtained with conventional packaging and application assemblies. This additional torque appreciably improves the sealing of the reservoir 2.

Figure 3D:
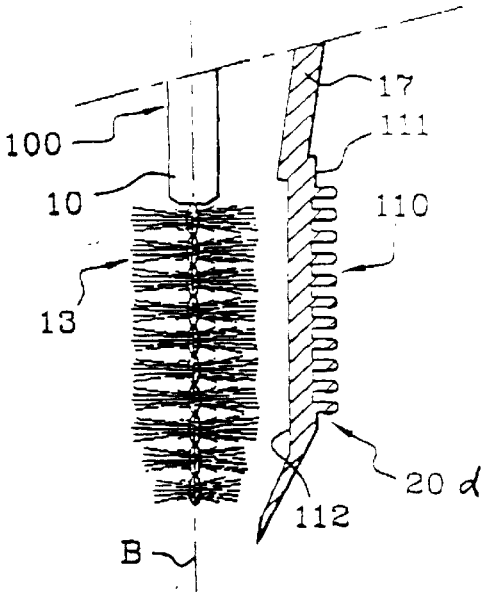
FIGS. 3D and 3E show partial side views of the applicator of FIG. 1 and different embodiments of the positioning member.
Figure 3E:
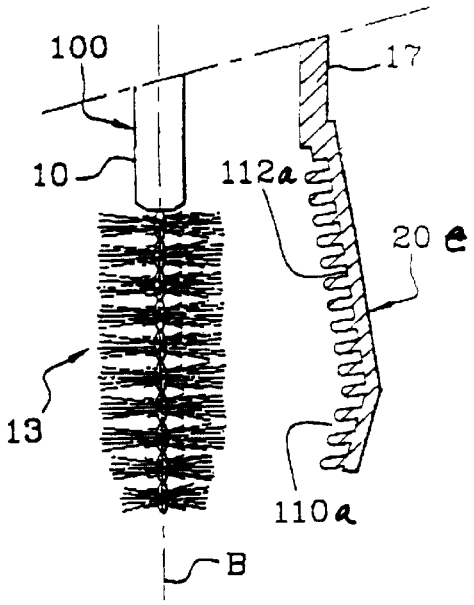
Figure 3A:
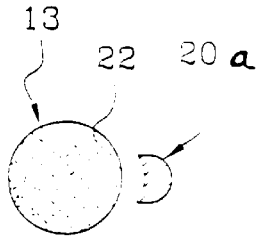
FIGS. 3A, 3B, and 3C show partial cross-sectional views taken along line 3—3 of FIG. 2A depict different embodiments of the positioning member.

FIGS. 3A–3E show the profile of different embodiments for the positioning member. As shown in each of these embodiments, the applicating member 13*a* preferably has a convex profile. Referring to FIG. 3A, a positioning member 20*a* is opposite to a portion of the applicating surface 22*a* of the applicating member 13*a*. Preferably, the portion extends in an angular region about the axis B of approximately 30°. In this embodiment, the profile of the surface of the positioning member 20*a* opposite to the applicating surface 22*a* is convex and has a radius of curvature substantially equal to the radius of curvature of the applicating,surface 22*a*.

Figure 3B:
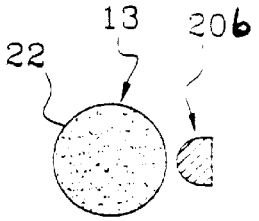

FIG. 3B shows another embodiment of the positioning member. In this embodiment, a surface of a positioning member 20*b* opposite to the applicating surface 22*a* is concave rather than convex. In addition, the positioning member 20*b* has a radius of curvature that is markedly smaller than the radius of curvature of the applicating surface 22*a*.

Figure 3C:
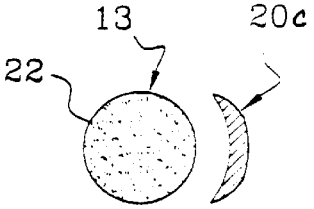

In FIG. 3C, a positioning member 20*c* faces the applicating surface 22*a* of the applicating member 13*a* over an angular region that is larger than shown in FIGS. 3A and 3B. For this embodiment, the angular region is from between about 50° to about 80°. The respective profiles of the applicating member 13*a* and the positioning member 20*c* are chosen depending on the type of hair to be treated and the desired application effects to the hair (e.g., curled eyelashes). In the exemplary embodiment shown in FIG. 3C, the positioning member 20*c* has a radius of curvature larger than that of the applicating surface 22*a*.

In FIG. 3D, the positioning member 20*d* includes opposing surfaces 111, 112. The surface 111 faces away from the applicating member 13 and includes one or more rows of teeth 110 extending outwardly from the surface 111. Although teeth are shown, the surface 111 may also include bristles. The teeth 110 can be used to comb a lock of keratinous fibers, particularly eyelashes after application of mascara.

FIG. 3E shows an embodiment of a positioning member 20*e* having teeth 110*a* extending from a surface 12*a* of the positioning member 20*e*. In this embodiment, the teeth 110*a* engage with the applicating member 13. Thus, in a single procedure, the user can load the eyelashes with product, separate them, and curl or lengthen them.

It will be apparent to those skilled in the art that various modifications and variations can be made to the structure and methodology of the present invention without departing from the spirit or scope of the invention.

In view of the foregoing, it is intended that the present invention cover modifications and variations of this invention, provided they fall within the scope of the following claims and their equivalents.

What is claimed is:

1. A system for applying product to keratinous fibers, the system comprising:

an applicator including an applicating member having an applicating surface configured to contact a lock of keratinous fibers and to apply product to the lock, and a positioning member opposing at least a portion of said applicating surface, the positioning member being configured to position the lock on said portion of said applicating surface when the applicating member is moved along the lock from the base of the lock to the tip of the lock; and a container including a reservoir having an interior configured to contain product and an opening permitting placement of the applicating member in the interior of the reservoir, and a receiving element configured to receive the positioning member and to locate the positioning member outside of the interior of the reservoir when the applicating member is in the interior of the reservoir.

2. The system of claim 1, wherein the applicator further includes a handle connected to both the applicating member and the positioning member, the handle being configured to engage a portion of the reservoir to sealingly close the opening of the reservoir when the applicating member is in the reservoir.

3. The system of claim 2, wherein the handle and the reservoir include threads, the threads on the handle being configured to engage the threads on the reservoir.

4. The system of claim 1, wherein said applicating surface extends around an axis to form a closed envelope and wherein said portion of said applicating surface extends in an angular region about said axis, said angular region being up to approximately 180 degrees.

5. The system of claim 4, wherein said angular region is up to approximately 120 degrees.

6. The system of claim 2, wherein the applicator further includes a wand having first and second ends, and wherein the applicating member has a free end and an end opposite to said free end, the end opposite to said free end being on the first end of the wand and the second end of the wand being connected to the handle.

7. The system of claim 2, wherein the applicator further includes an arm having first and second ends, the positioning member being on the first end of the arm and the handle being connected to the second end of the arm, the applicator being configured so that when the applicating member is placed in the interior of the reservoir, the arm extends in a direction substantially parallel to an axis of the reservoir, outside of the reservoir.

8. The system of claim 1, wherein the receiving element includes a cup at least partially surrounding the reservoir, said cup having a closed end adjacent to a bottom of the reservoir and an open end opposite to the closed end, the open end permitting passage of the positioning member into the cup, and wherein the distance between the closed end and the open end is at least as long as the axial length of the positioning member.

9. The system of claim 3, wherein the receiving element is coupled to the reservoir so that the receiving element does not rotate relative to the reservoir and wherein the positioning member is coupled to the handle so that the positioning member does not rotate relative to the handle.

10. The system of claim 1, wherein the positioning member is configured to move from a first position remote from said applicating surface to a second position adjacent to said applicating surface to facilitate positioning of a lock of keratinous fibers on said applicating surface.

11. The system of claim 10, wherein the positioning member includes a surface for receiving a pressing force for moving the positioning member from the first position to the second position.

12. The system of claim 1, wherein the applicating member includes a brush having a core holding bristles extending radially at least partially around the core.

13. The system of claim 1, wherein the applicator further includes a selecting portion configured to facilitate selection of a specific lock of keratinous fibers and a guide to facilitate positioning of the lock on the applicating surface.

14. The system of claim 13, wherein the selecting portion and the guide are on the positioning member, the selecting portion including a point at a free end of the positioning member, the guide being a stop adjacent to an end of the positioning member opposite to the free end, the stop limiting movement of the lock of keratinous fibers in a direction facing away from the selecting portion.

15. The system of claim 1, wherein the positioning member includes a comb having a plurality of at least one of teeth and bristles.

16. The system of claim 1, wherein the applicating member includes foam material.

17. The system of claim 1, wherein the reservoir includes a wiper for wiping excess product from the applicating member when the applicating member is removed from the interior of the reservoir.

18. The system of claim 1, wherein a side of the positioning member facing toward the applicating member has a plurality of at least one of teeth and bristles.

19. The system of claim 1, wherein the positioning member includes a first side facing toward the applicating member and a second side facing away from the applicating member, the first side being flat and having a profile substantially the same as a profile of the applicating member, and the second side including a plurality of at least one of teeth and bristles.

20. The system of claim 1, wherein said portion of said applicating surface has a convex profile and a side of the positioning member facing said applicating surface has a concave profile having a radius of curvature substantially the same as the radius of curvature of said applicating surface.

21. The system of claim 1, wherein said portion of said applicating surface has a convex profile and a side of the positioning member facing said applicating surface has a concave profile having a radius of curvature larger than the radius of curvature of the applicating surface.

22. The system of claim 1, wherein said portion of said applicating surface has a convex profile and a side of the positioning member facing said applicating surface has a convex profile.

23. The system of claim 1, further comprising a product in the interior of the reservoir.

24. The system of claim 23, wherein the product is mascara.

25. A method of applying product to keratinous fibers using the system of claim 23, the method comprising:

placing the applicator on the container so that the applicating member contacts product in the interior of the reservoir and the positioning member is positioned in the receiving element;

selecting a lock of keratinous fibers for treatment;

positioning the lock between the applicating surface and the positioning member; and moving the applicating member along the lock from the base of the lock to the tip of the lock to transfer the product from the applicating member to the lock.

26. The method of claim 25, wherein the positioning member is configured to selectively move from a first position remote from the applicating member to a second position adjacent to the applicating member, and wherein the positioning of the lock of keratinous fibers further includes moving the positioning member to the second position to hold the lock of keratinous fibers between the applicating member and the positioning member.

27. The method of claim 25, wherein the moving of the applicating member includes moving the applicating member along a curved path to curl the lock of keratinous fibers.

28. The method of claim 25, wherein the product is mascara and the keratinous fibers are eyelashes.

29. The method of claim 25, wherein the system further includes a wiper on the reservoir for wiping excess product from the applicating member, the method further comprising removing the applicating member from the interior of the reservoir and wiping the applicating member on the wiper to remove excess product from the applicating member.

30. A method of applying product to keratinous fibers using a system including an applicator and a container, the applicator including an applicating member having an applicating surface configured to contact a lock of keratinous fibers and to apply product to the lock, and a positioning member configured to position the lock on a portion of said applicating surface, the container including a reservoir having an interior containing a product and an opening permitting placement of the applicating member in the interior of the reservoir, the method comprising:

placing the applicator on the container so that the applicating member contacts the product in the interior of the reservoir while the positioning member is outside of the reservoir without being placed in the interior of the reservoir;

selecting a lock of keratinous fibers for treatment;

positioning the lock between the applicating surface and the positioning member;

and moving the applicating member along the lock from the base of the lock to the tip of the lock to transfer the product from the applicating member to the lock.

* * * * *